US009016030B1

(12) United States Patent
Steele

(10) Patent No.: US 9,016,030 B1
(45) Date of Patent: Apr. 28, 2015

(54) METAL DOOR

(71) Applicant: Ryan D. Steele, Springfield, NE (US)

(72) Inventor: Ryan D. Steele, Springfield, NE (US)

( * ) Notice: Subject to any disclaimer, the term of this patent is extended or adjusted under 35 U.S.C. 154(b) by 0 days.

(21) Appl. No.: 14/300,743

(22) Filed: Jun. 10, 2014

(51) Int. Cl.
*E04C 2/54* (2006.01)
*E06B 3/72* (2006.01)

(52) U.S. Cl.
CPC ..... *E06B 3/726* (2013.01)

(58) Field of Classification Search
CPC ..... E06B 3/726
USPC ..... 52/784.15, 784.11, 801.11, 309.11
See application file for complete search history.

(56) References Cited

U.S. PATENT DOCUMENTS 4,327,535 A * 5/1982 Governale ..... 52/309.11
4,430,836 A * 2/1984 McKann ..... 52/455
4,546,585 A * 10/1985 Governale ..... 52/309.11
4,720,951 A * 1/1988 Thorn et al. ..... 52/208
4,897,975 A * 2/1990 Artwick et al. ..... 52/208
5,074,087 A * 12/1991 Green ..... 52/309.9
5,077,948 A * 1/1992 Olson et al. ..... 52/309.9
5,105,597 A * 4/1992 Wilkening ..... 52/455
5,613,324 A * 3/1997 Theune ..... 49/380
5,644,870 A * 7/1997 Chen ..... 49/501
5,749,184 A * 5/1998 McKann ..... 52/204.1
6,068,802 A * 5/2000 Berghorn et al. ..... 264/46.5
6,112,496 A * 9/2000 Hugus et al. ..... 52/784.11
6,161,363 A * 12/2000 Herbst ..... 52/784.15
6,311,454 B1 * 11/2001 Kempel ..... 52/784.15
6,622,449 B2 * 9/2003 Smith et al. ..... 52/656.9
6,729,095 B2 * 5/2004 Wang Chen ..... 52/456
7,748,120 B2 * 7/2010 Turner et al. ..... 29/897.31
8,534,027 B1 * 9/2013 Cullinane et al. ..... 52/784.15
8,656,684 B1 2/2014 Cullinane

* cited by examiner

*Primary Examiner* — Basil Katcheves
(74) *Attorney, Agent, or Firm* — Dennis L. Thomte; Thomte Patent Law Office LLC

(57) ABSTRACT

Two embodiments of a metal door are described and shown. In one embodiment, the door includes a metal exterior panel member and a metal interior panel member. Insulation members are positioned between the upper end edges of the panel members, the first side edges of the panel members, the lower end edges of the panels and the second side edges of the panel members. The panel members are uniquely secured to the insulation members. A foam insulation is positioned between the panel members inwardly of the insulation members. In the second embodiment, each panel member is comprised of an upper metal frame member, a first metal side frame member, a lower metal frame member and a metal second side frame member. Insulation members are positioned between the frame members of the panel members. The second embodiment also includes cut-out areas for insertion of glass therebetween.

12 Claims, 8 Drawing Sheets

METAL DOOR

BACKGROUND OF THE INVENTION

1. Field of the Invention

This invention relates to a metal door and more particularly to a metal door which is comprised of an exterior panel member and an interior panel member which are secured together. Even more particularly, this invention relates to a metal door wherein the exterior and interior panel members have insulation members therebetween with the side flanges of the interior and exterior panel members being secured to the insulation members by screws.

2. Description of the Related Art

Many types of metal doors have been previously provided. The metal doors of the prior art are very durable and are resistant to forced entry attempts by burglars or the like. A problem associated with the metal doors of the prior art is encountered when the metal doors are subjected to cold temperatures. In such a situation, the inside portion of the metal doors of the prior art may "frost-up" when the metal doors are subjected to very cold temperatures.

Applicant's earlier metal doors, such as described in U.S. Pat. Nos. 8,534,027 and 8,656,684, represent distinct improvements in the metal door art. However, since the exterior and interior panel members of the '027 and '684 patents were each constructed of tubular steel members, the doors thereof are quite heavy. In an effort to reduce the weight of Applicant's metal doors, without sacrificing the insulation benefits thereof, the instant invention is provided.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

Two embodiments of a metal door are disclosed. In the first embodiment, the door includes an exterior metal panel member, having an upper end edge, a lower end edge, a first side edge, a second side edge, a front side and a rear side. The external panel member has flanges extending transversely rearwardly from the upper end edge, the lower end edge, a first side edge, and a second side edge. The first embodiment includes a metal interior panel member having an upper end edge, a lower end edge, a first side edge and a second side edge. The internal panel member has flanges extending transversely forwardly from the upper end edge, the lower end edge, the first side edge and the second side edge thereof. When the exterior panel member and the interior panel member are assembled, the rearward ends of the flanges of the exterior panel member and the forward ends of the flanges of the interior panel member are spaced apart to provide an insulated air gap therebetween.

Insulation members, such as wood, laminated wood, fiberglass, plastic or composite material are positioned between the upper end edges of the panel members, the first side edges of the panel members, the lower end edge of the panel members and the second side edges of the panel members. The flanges of the exterior panel member and the interior panel member are secured to the insulation members. The space between the insulation members between the back side of the exterior panel member and the front side of the interior panel is filled with an insulating foam material.

The second embodiment of the invention is illustrated and described wherein each of the exterior and interior panel members have an upper frame member, a first side frame member, a lower frame member, and a second side frame member. Each of the frame members of the exterior panel member have rearwardly extending flanges extending therefrom. Each of the edges of the interior panel member has forwarding extending flanges extending therefrom. Insulation members are provided between the frame members of the exterior panel member and the interior panel member with the flanges of the panel members being secured to the outermost insulation members. The panel members have cutout portions formed therein for the insertion of glass members therein.

It is therefore a principal object of the invention to provide an improved metal door.

A further object of the invention is to provide an improved metal door which is lighter in weight than conventional metal doors.

A further object of the invention is to provide a metal door of the type described which includes a unique way of securing the exterior panel member and the interior panel member together so that the rearwardly extending flanges of the exterior panel member and the forwardly extending flanges of the interior panel member are spaced-apart to form an air gap therebetween.

A further object of the invention is to provide a metal door wherein the exterior panel and the interior panel thereof are spaced-apart with insulation materials.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
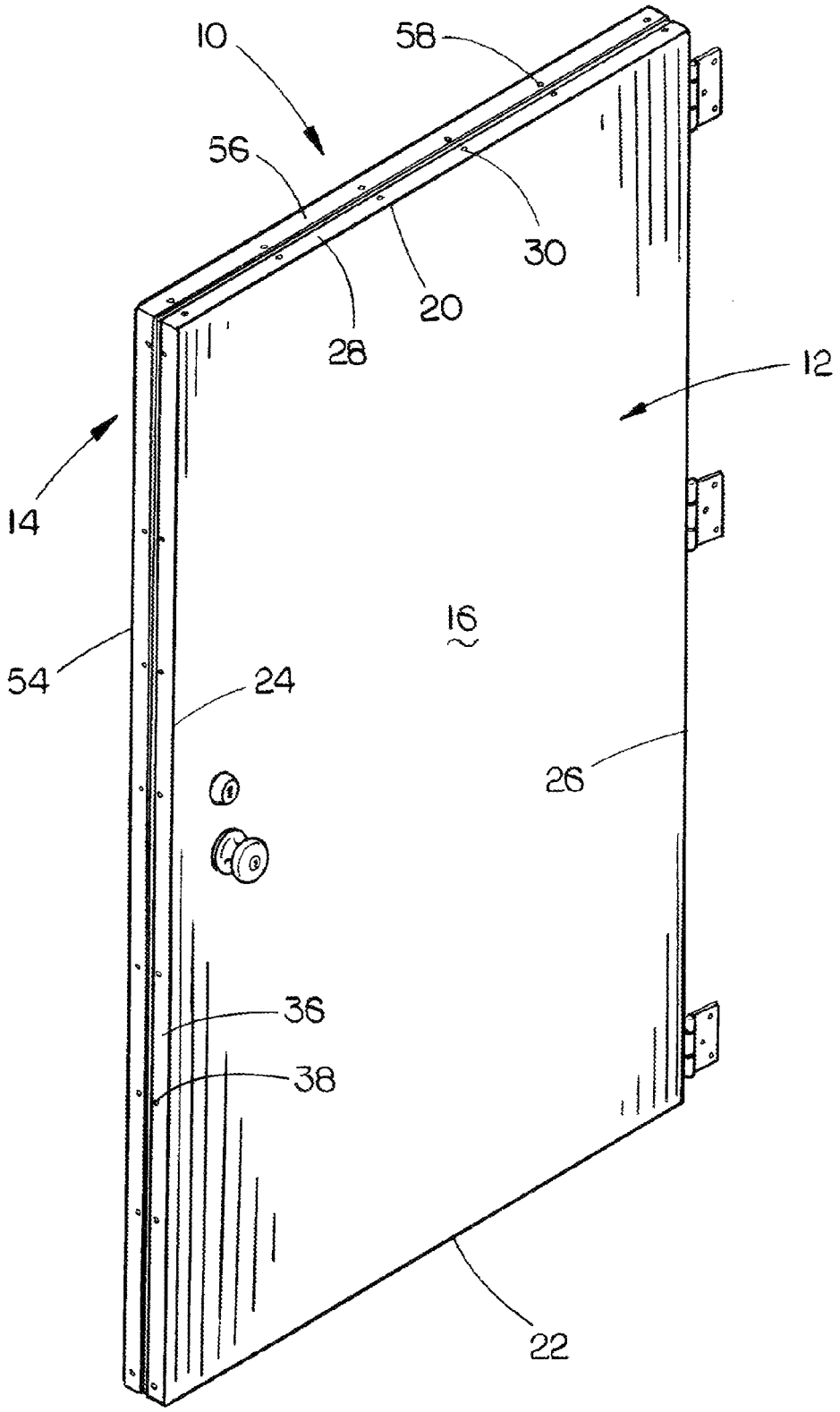
FIG. 1 is an exterior perspective view of a first embodiment of the door of this invention.
Figure 2:
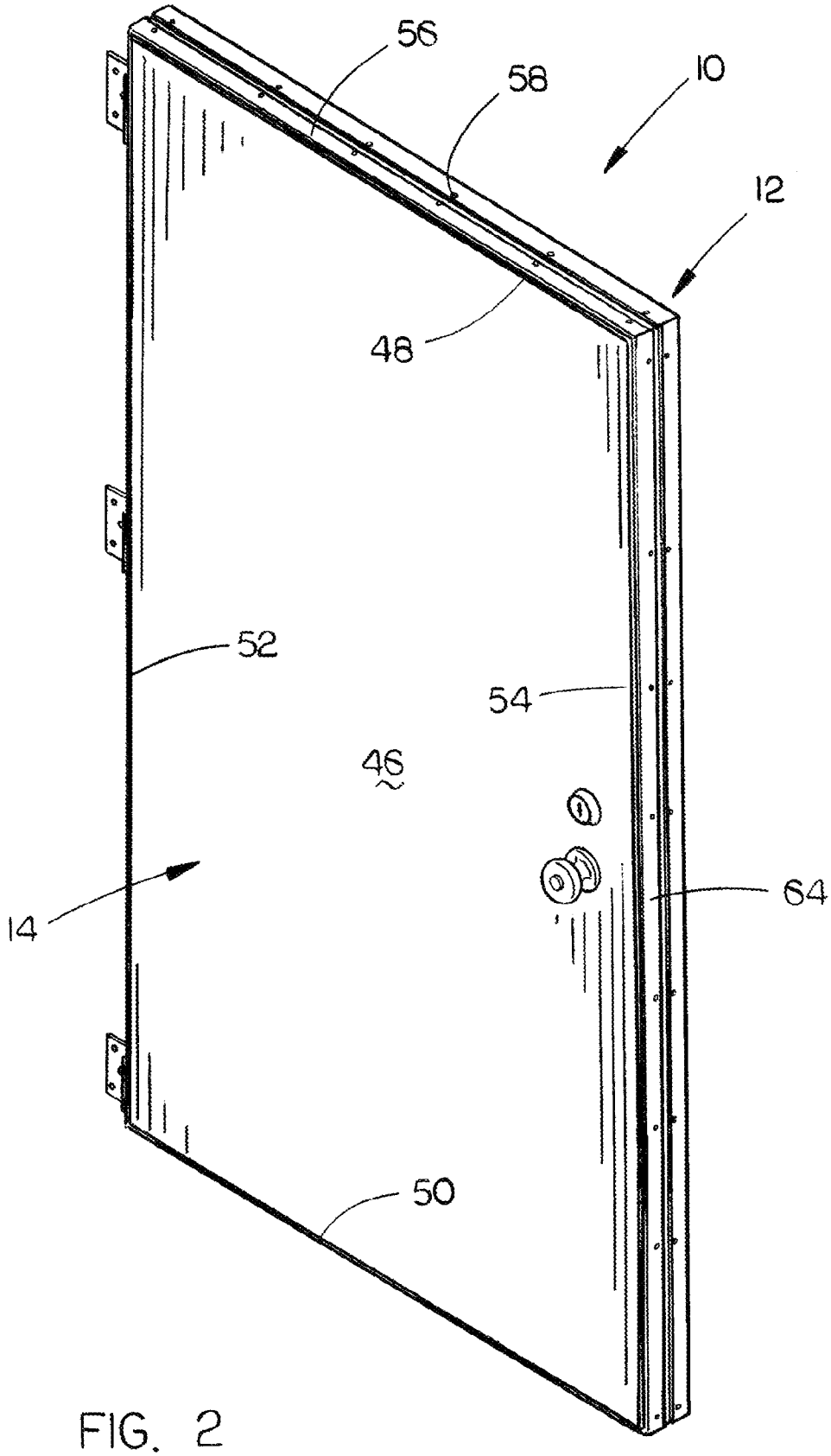
FIG. 2 is an interior perspective view of the first embodiment of the door of this invention.
Figure 3:
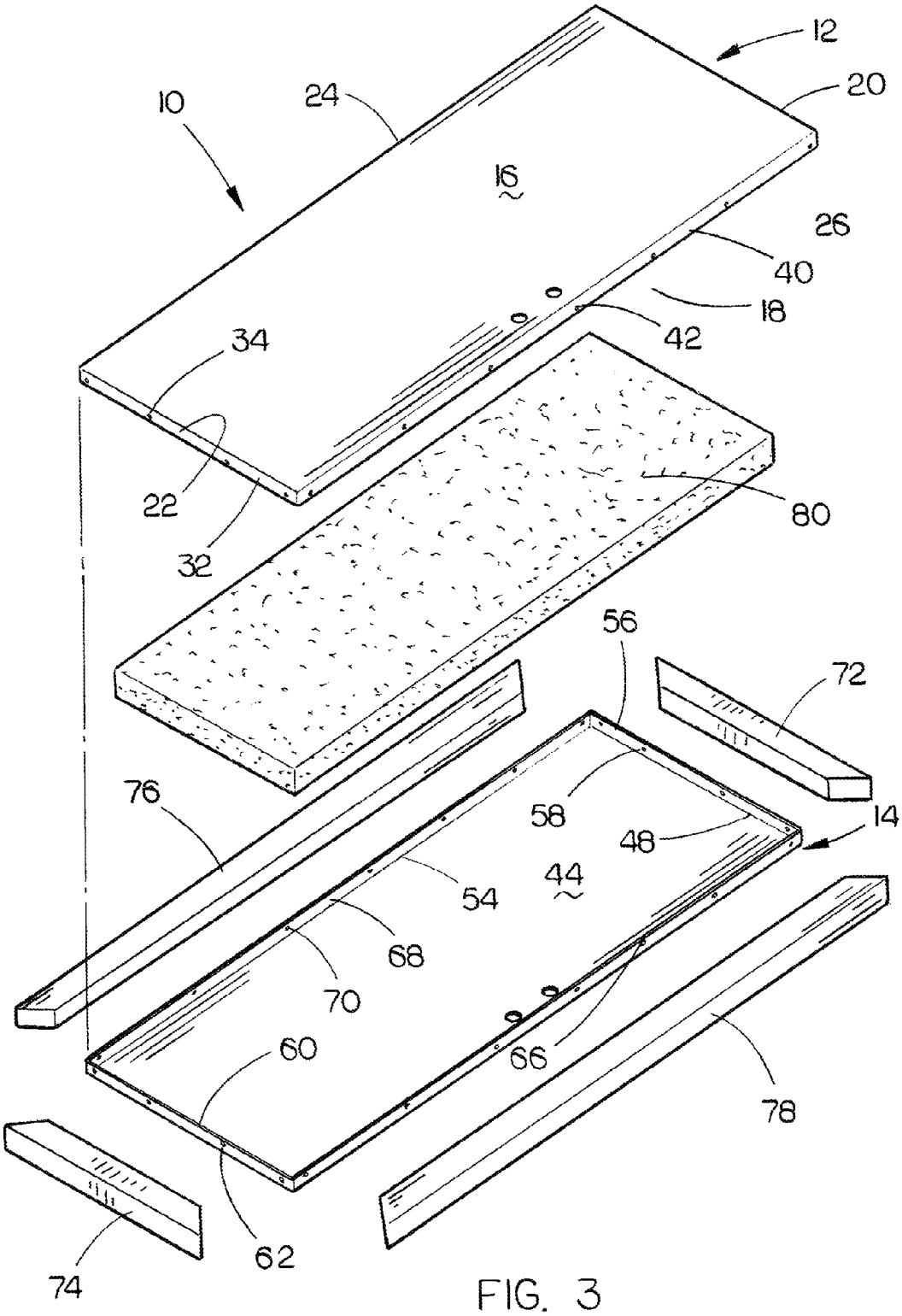
FIG. 3 is an exploded perspective view of the components of the first embodiment of the door of FIGS. 1 and 2.
Figure 4:
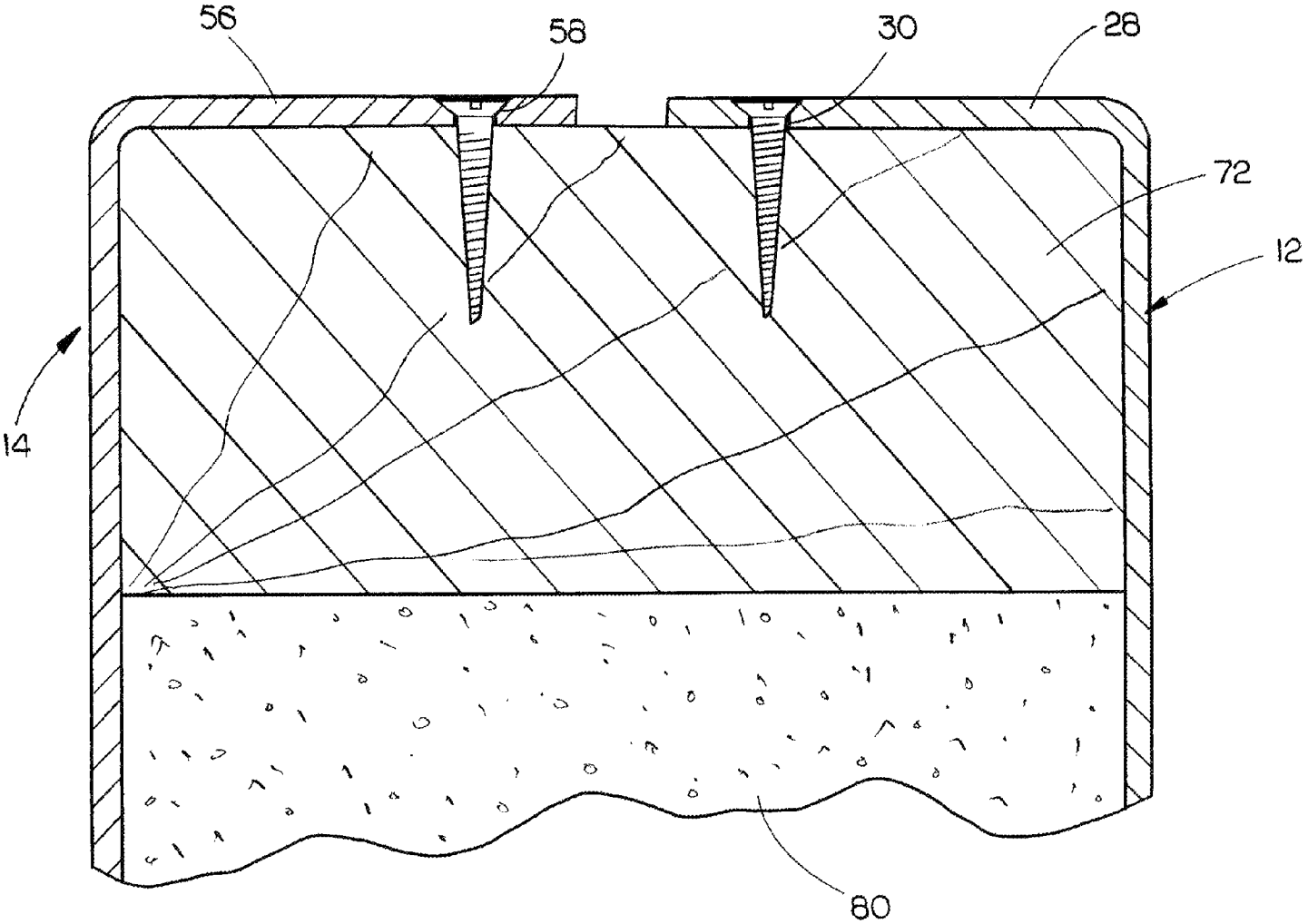
FIG. 4 is a sectional view of a portion of the door of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

One embodiment of the metal door of this invention is illustrated in FIGS. 1-4 and designated with the reference numeral 10. Door 10 includes a metal exterior panel member 12 and a metal interior panel 14 which are secured together as will be described hereinafter. For purposes of description, exterior panel member 12 will be described as having a front side 16 and a back side 18. Panel member 12 includes an upper end edge 20, a lower end edge 22, a first side edge 24 and a second side edge 26. An upper flange 28 extends transversely rearwardly from upper end edge 20 of panel member 12 and has a plurality of spaced-apart and counter-sunk screw openings 30 formed therein. A lower flange 32 extends transversely rearwardly from the lower end edge 22 of panel member 12 and has a plurality of spaced-apart and counter-sunk screw openings 34 formed therein. A first side flange 36 extends transversely rearwardly from the first side edge 24 and has a plurality of spaced-apart and counter-sunk screw openings 38 formed therein. A second side flange 40 extends transversely rearwardly from the second side edge 26 of panel member 12 and has a plurality of spaced-apart and counter-sunk screw openings 42 formed therein.

The interior panel member 14 includes a front side 44 and a back side 46, an upper end edge 48, a lower end edge 50, a first side edge 52, and a second side edge 54. An upper flange 56 extends transversely forwardly from upper end edge 48 and has a plurality of spaced-apart and counter-sunk screw openings 58 formed therein. A lower flange 60 extends transversely forwardly from the lower end edge 50 of panel member 14 and has a plurality of spaced-apart and counter-sunk screw openings 62 formed therein. A first side flange 64 extends transversely forwardly from the first side edge 52 of panel member 14 and has a plurality of spaced-apart and counter-sunk screw openings 66 formed therein. A second side flange 68 extends transversely forwardly from second side edge 54 of panel member 14 and has a plurality of spaced-apart and counter-sunk screw openings 70 formed therein.

The panel members 12 and 14 are positioned so that the front side 44 of panel member 14 is positioned rearwardly of the back side 18 of panel member 12. The panel members 12 and 14 are vertically spaced-apart so that the rearward ends of flanges 28, 32, 36 and 40 of panel member 12 are spaced from the forward ends of flanges 56, 60, 68 and 64 of panel member 14.

The numeral 72 refers to an elongated and horizontally disposed upper insulation member which is positioned between the back side 18 of panel member 12 and the front side 44 of panel member 14 adjacent the flanges 28 and 56. The numeral 74 refers to an elongated and horizontally disposed lower insulation member which is positioned between the back side 18 of panel member 12 and the front side 44 of panel member 14 adjacent the flanges 32 and 60.

The numeral 76 refers to an elongated and vertically disposed first side insulation member which is positioned between the back side 18 of panel member 12 and the front side 44 of panel member 14 adjacent the flanges 36 and 68. The numeral 78 refers to an elongated and vertically disposed second side insulation member which is positioned between the back side 18 of panel member 12 and the front side 44 of panel member 14 adjacent the flanges 40 and 64.

The insulation members 72, 74, 76 and 78 may be comprised of a wood material, a laminated wood material, a fiberglass material, a plastic material or a composite material. The insulation members 72, 74, 76 and 78 must be insulative and have sufficient strength to receive screws inserted therein-into.

A plurality of screws extend downwardly through screw openings 30 in upper flange 28 of panel member 12 into insulation member 72. A plurality of screws extend upwardly through screw openings 34 in lower flange 32 of panel member 12 into insulation member 74. A plurality of screws extend horizontally through screw openings 38 in the flange 36 of panel member 12 into insulation member 76. A plurality of screws extend horizontally through screw openings 42 in the second side flange 40 into insulation member 78.

A plurality of screws extend downwardly through screw openings 58 in flange 56 of panel member 14 into insulation member 72. A plurality of screws extend upwardly through screw openings 62 in flange 60 of panel member 14 into insulation member 74. A plurality of screws extend horizontally inwardly through screw openings 70 of flange 68 of panel member 14 into insulation member 76. A plurality of screws extend inwardly through screw openings 66 of flange 64 of panel member 14 into insulation member 78.

When the panel members 12 and 14 are secured to the insulation members 72, 74, 76 and 78 as described above, the rearward ends of the flanges of panel member 12 are spaced from the forward ends of the flanges on panel member 14 to provide an insulating air gap therebetween. When the panel members 12 and 14 are secured together as described above, a space is created between the panel members inwardly of the insulation members 72, 74, 76 and 78. The space is filled with an insulation foam material generally designated by the reference numeral 80.

The back side or interior side of interior panel member 14 may have a wood veneer panel or a fiberglass decorative panel secured thereto for appearance purposes.

A second embodiment of the metal door of this invention is illustrated in FIGS. 5-8 and is designated by the reference numeral 82. Door 82 differs from door 10 in that the exterior and interior panels of FIGS. 1-4 do not have any glass areas formed therein as does door 82. Door 82 includes an exterior panel member 84 and an interior panel member 86. Panel member 84 includes an upper frame member 88, a lower frame member 90, a first side frame member 92 and a second side frame member 94. Panel member 82 also includes a curved frame member 96 which extends between side frame members 92 and 94. Panel member 82 also includes a corner frame member 98. The frame members 96 and 98 define an opening 100. The frame members 92, 90, 94 and 96 define an opening 102. The frame members 88, 90, 92, 94 and 96 are welded together at their junctures.

Panel member 86 includes an upper frame member 104, a lower frame member 106, a first side frame member 108, and a second frame member 110. Panel member 86 also includes a curved frame member 112 and a curved frame member 114. The frame members of panel member 86 define openings 116 and 118 which correspond to openings 100 and 102 respectively of panel member 84. Glass members are positioned in the openings 100, 102, 116 and 118. The frame members 104, 106, 108, 110 and 112 are welded together at their junctures.

Figure 5:
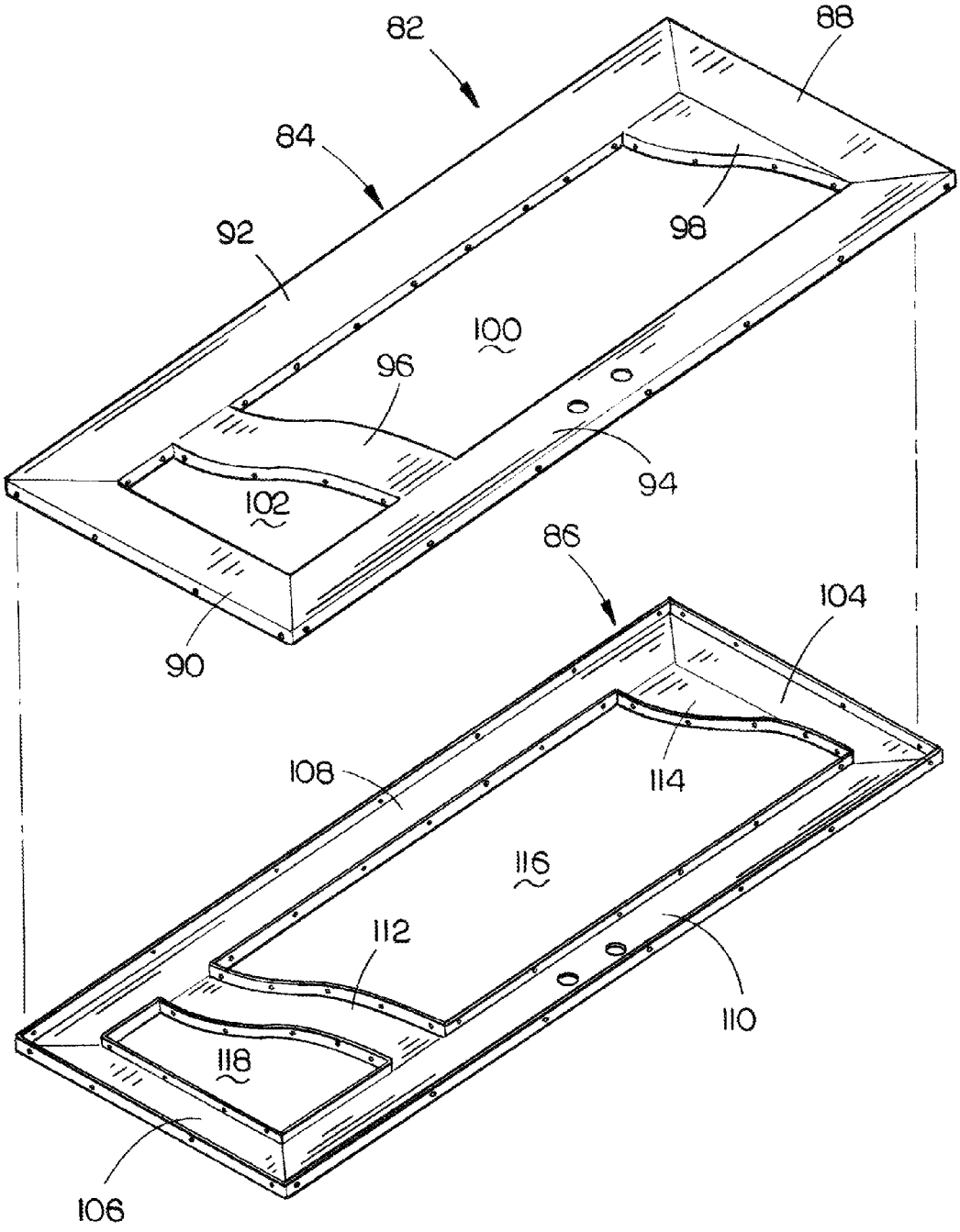
FIG. 5 is an exploded perspective view of a second embodiment of the door of this invention.

All the frame members of panel member 84 include flanges which extend rearwardly therefrom as illustrated in FIG. 5. All the frame members of panel member 86 include flanges which extend forwardly therefrom. When the panel members 84 and 86 are positioned adjacent one another, the rearward ends of the rearwardly extending flanges of panel member 84 are spaced from the forward ends of the forwardly extending flanges of panel member 86 in the same fashion as in the first embodiment 10.

Figure 6:
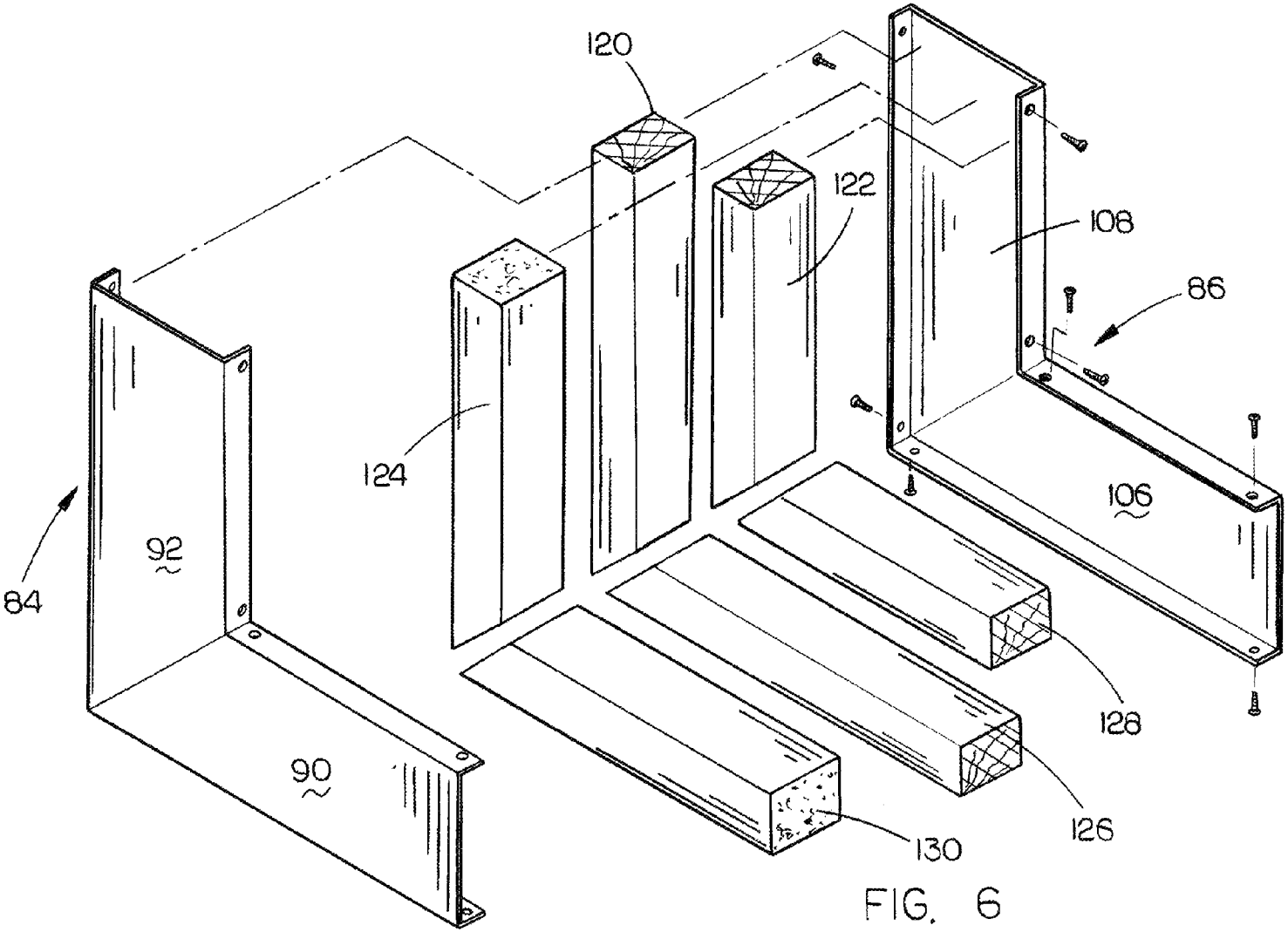
FIG. 6 is a partial exploded perspective view of a portion of the door of FIG. 5.
Figure 7:
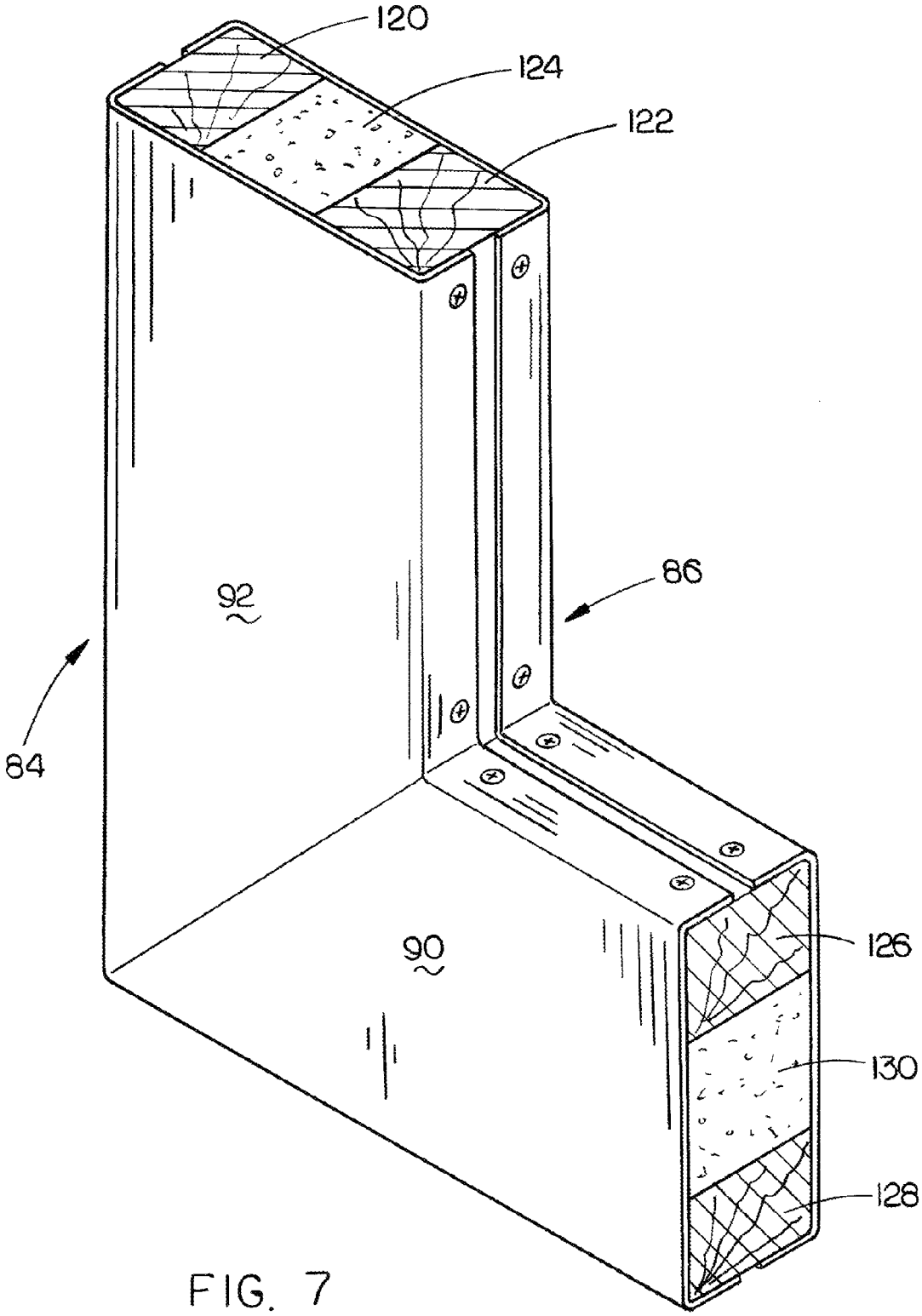
FIG. 7 is a partial perspective view illustrating one corner of the door of FIGS. 5 and 6.
Figure 8:
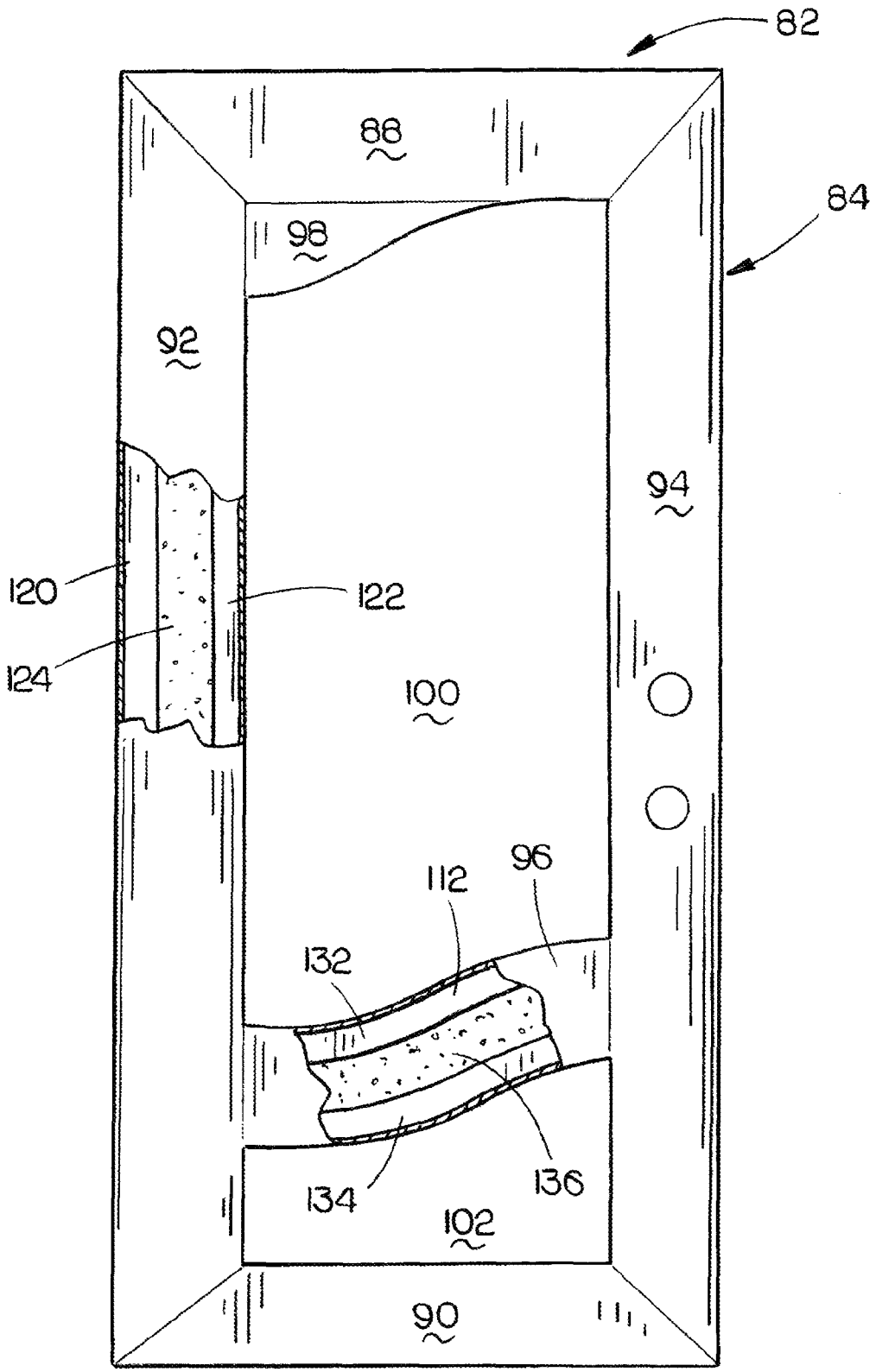
FIG. 8 is a front view of the door of FIGS. 5-7 with a portion thereof cutaway to more fully illustrate the invention.

FIG. 6 illustrates three insulation members which are positioned between each of the matching frame members of panel members. For example, an elongated insulation member 120 is positioned inwardly of and between the outer flanges of frame members 92 and 108. An elongated insulation member 122 is positioned inwardly and between the inner flanges of frame members 92 and 108. A foam insulation member 124 is positioned between the insulation members 120 and 122. The flanges of frame member 92 are secured to the insulation members 120 and 122 by screws as seen in FIG. 6. The flanges of frame member 108 are secured to the insulation members 120 and 122 by screws as seen in FIG. 6. An elongated insulation member 126 is positioned inwardly of and between the lower flanges of frame members 90 and 106. An elongated insulation member 128 is positioned inwardly and between the upper flanges of frame members 90 and 106. A foam insulation member 130 is positioned between the insulation member 126 and 128. The flanges of frame member 90 are secured to the insulation members 126 and 128 by screws as seen in FIG. 6. The flanges of frame member 106 are secured to the insulation members 126 and 128 by screws as seen in FIG. 6. The insulation members 120, 122, 126 and 128 are comprised of wood, laminated wood, plastic or a composite material.

The frame members 96 and 112 also have insulation members 132, 134 and 136 positioned therebetween. Insulation members 132 and insulation member 134 are comprised of wood, laminated wood, fiberglass, plastic or a composite material. Insulation member 136 is comprised of an insulative foam material. The upper flanges of frame members 96 and 112 are secured to insulation member 132 by screws. The lower flanges of frame members 96 and 112 are secured to insulation member 134 by screws. The rearward ends of the rearwardly extending flanges of frame member 96 are spaced from the forward ends of the forwardly extending flanges of frame member 112.

The rearwardly extending flange of corner frame member 96 is spaced forwardly of the forward end of the forwardly extending flange of corner frame member 114. The interior of the corner frame members 98 and 114 have the same insulation members herein as the other frame members described above.

Thus it can be seen that improved metal doors are provided which are lighter than the prior art metal doors and have excellent insulation qualities.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A door, comprising:

a vertically disposed and horizontally extending metal exterior upper frame member having an upper end, a lower end, a first end, a second end, a front side and a rear side;

an upper metal flange extending transversely rearwardly from said upper end of said exterior upper frame member;

said upper flange of said exterior upper frame member having a rearward end;

a lower metal flange extending transversely rearwardly from said lower end of said exterior upper frame member;

said lower flange of said upper frame member having a rearward end;

a vertically disposed and vertically extending metal exterior first side frame member having an upper end, a lower end, an outer end, an inner end, a front side and a rear side;

a first metal flange, having a rearward end, extending transversely rearwardly from said outer end of said exterior first side frame member;

a second metal flange, having a rearward end, extending transversely rearwardly from said inner end of said exterior first side frame member;

said upper end of said first side frame member of said exterior upper frame member being secured to said first end of said exterior upper frame member so as to extend downwardly therefrom in a transverse manner;

a vertically disposed and horizontally extending metal exterior lower frame member having an upper end, a lower end, a first end, a second end, a front side and a rear side;

a first metal flange extending transversely rearwardly from said upper end of said exterior lower frame member;

said first flange of said exterior lower frame member having a rearward end;

a second metal flange extending transversely rearwardly from said lower end of said exterior lower frame member;

said second flange of said lower end of said exterior lower frame member having a rearward end;

said first end of said exterior lower frame member being secured to said lower end of said exterior first side frame member;

a vertically disposed and vertically extending metal exterior second side frame member having an upper end, a lower end, an outer end, an inner end, a front side and a rear side;

a first metal flange extending transversely rearwardly from said outer end of said exterior second side frame member;

a second metal flange extending transversely rearwardly from said inner end of said exterior second side frame member;

said lower end of said exterior second side frame member being secured to said second end of said exterior lower frame member;

said upper end of said exterior second side frame member being secured to said second end of said exterior upper frame member;

a vertically disposed and horizontally extending metal interior upper frame member having an upper end, a lower end, a first end, a second end, a front side and a rear side;

an upper metal flange extending transversely forwardly from said upper end of said interior upper frame member;

said upper metal flange of said interior upper frame member having a forward end;

a lower metal flange extending transversely forwardly from said lower end of said interior upper frame member;

said lower flange of said interior upper frame member having a forward end;

a vertically disposed and vertically extending metal interior first side frame member having an upper end, a lower end, an outer end, an inner end, a front side and a rear side;

a first metal flange, having a rearward end, extending transversely forwardly from said outer end of said interior first side frame member;

a second metal flange, having a rearward end, extending transversely forwardly from said inner end of said interior first side frame member;

said upper end of said first side frame member being secured to said first end of said interior upper frame member so as to extend downwardly therefrom in a transverse manner;

a vertically disposed and horizontally extending metal interior lower frame member having an upper end, a lower end, a first end, a second end, a front side and a rear side;

a first metal flange, having a rearward end, extending transversely forwardly from said upper end of said interior lower frame member;

a second metal flange, having a rearward end, extending transversely forwardly from said lower end of said interior lower frame member;

said first end of said interior lower frame member being secured to said lower end of said interior first side frame member;

a vertically disposed and vertically extending metal interior second frame member having an upper end, a lower end, an outer end, an inner end, a front side and a rear side;

a first metal flange extending transversely forwardly from said outer end of said interior second side frame member;

a second metal flange extending transversely forwardly from said inner end of said interior second side frame member;

said lower end of said interior second side frame member being secured to said second end of said interior lower frame member;

said upper end of said interior second side frame member being secured to said second end of said interior upper frame member;

said upper frame members of said exterior and interior panel members having insulation positioned therebetween;

said first side frame members of said exterior and interior panel members having insulation positioned therebetween;

said lower frame members of said exterior and interior panel members having insulation positioned therebetween;

said second side frame members of said exterior and interior panel members having insulation positioned therebetween;

said frame members of said external and interior panel members being secured to the insulation positioned adjacent thereto.

2. The door of claim 1 wherein said insulation comprises a wood material.

3. The door of claim 1 wherein said insulation comprises a plastic material.

4. The door of claim 1 wherein said insulation comprises a foam material.

5. The door of claim 1 wherein said insulation comprises a wood member positioned adjacent said flanges.

6. The door of claim 1 wherein said insulation comprises a plastic member positioned adjacent said flanges.

7. The door of claim 1 wherein said insulation comprises a composite material positioned adjacent said flanges.

8. The door of claim 1 wherein said insulation comprises a fiberglass material positioned adjacent said flanges.

9. The door of claim 1 wherein said insulation comprises a wood member, a foam member and a wood member.

10. The door of claim 1 wherein said insulation comprises a plastic member, a foam member and a plastic member.

11. The door of claim 1 wherein said insulation comprises a composite member, a foam member and a composite member.

12. The door of claim 1 wherein said insulation comprises a fiberglass member, a foam member and a fiberglass member.

* * * * *